US010747160B2

(12) United States Patent
Hikosaka

(10) Patent No.: US 10,747,160 B2
(45) Date of Patent: Aug. 18, 2020

(54) IMAGE FORMING APPARATUS THAT DETECTS NEAR DEPLETION OF TONER AND METHOD FOR DETECTING NEAR DEPLETION OF TONER

(71) Applicant: KYOCERA Document Solutions Inc., Osaka (JP)

(72) Inventor: Ariyoshi Hikosaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/560,135

(22) Filed: Sep. 4, 2019

(65) Prior Publication Data

US 2020/0081387 A1 Mar. 12, 2020

(30) Foreign Application Priority Data

Sep. 6, 2018 (JP) ..... 2018-166526

(51) Int. Cl.
*G03G 15/00* (2006.01)

(52) U.S. Cl.
CPC ..... *G03G 15/556* (2013.01)

(58) Field of Classification Search
None
See application file for complete search history.

(56) References Cited

U.S. PATENT DOCUMENTS 9,927,755 B2 * 3/2018 Okada ..... G03G 15/556

FOREIGN PATENT DOCUMENTS

JP 2013-029657 A 2/2013
JP 2015-087576 A 5/2015

* cited by examiner

*Primary Examiner* — Victor Verbitsky
(74) *Attorney, Agent, or Firm* — Studebaker & Brackett PC

(57) ABSTRACT

An image forming apparatus includes: a first toner consumption amount calculation section which calculates a toner consumption amount based on a toner replenishment operation; a coefficient calculation section which calculates a coefficient by dividing the toner consumption amount calculated by the first toner consumption amount calculation section by a number of pixels; a second toner consumption amount calculation section which calculates the toner consumption amount by multiplying the number of pixels by the coefficient calculated by the coefficient calculation section; and a near depletion detector which detects near depletion when a total toner consumption amount exceeds a near depletion threshold value. When a difference between a coefficient reference value and the coefficient calculated by the coefficient calculation section is at most an allowable value, the near depletion detector changes the near depletion threshold value to a changed near depletion threshold value which is smaller than the near depletion threshold value.

12 Claims, 2 Drawing Sheets

IMAGE FORMING APPARATUS THAT DETECTS NEAR DEPLETION OF TONER AND METHOD FOR DETECTING NEAR DEPLETION OF TONER

INCORPORATION BY REFERENCE

The present application claims priority under 35 U.S.C. § 119 to Japanese Patent Application No. 2018-166526, filed on Sep. 6, 2018. The contents of this application are incorporated herein by reference in their entirety.

BACKGROUND

The present disclosure relates to an image forming apparatus which accepts attachment and detachment of a toner container housing toner to be supplied to a development device of the image forming apparatus.

A technique is proposed for an image forming apparatus including a toner container. Through the technique, a toner consumption amount is calculated based on operation of a toner conveyance section which conveys toner from the toner container and a number of pixels in image data to be printed. By detecting the toner consumption amount, a state in which the toner is nearly depleted (referred to in the following as near depletion) is detected before toner depletion is detected, and time for a user to prepare a replacement toner container is ensured.

SUMMARY

An image forming apparatus according to an aspect of the present disclosure accepts attachment and detachment of a toner container. The toner container houses toner with which a development device of the image forming apparatus is replenished. The image forming apparatus includes a first toner consumption amount calculation section, a pixel counting section, a coefficient calculation section, a second toner consumption amount calculation section, and a near depletion detector. The first toner consumption amount calculation section calculates a toner consumption amount based on a toner replenishment operation through which the development device is replenished with toner from the toner container. The pixel counting section counts pixels in printed image data. The coefficient calculation section calculates a coefficient by dividing the toner consumption amount calculated by the first toner consumption amount calculation section by a number of the pixels counted by the pixel counting section. The second toner consumption amount calculation section calculates the toner consumption amount by multiplying the number of the pixels counted by the pixel counting section by the coefficient calculated by the coefficient calculation section. The near depletion detector detects near depletion approaching toner depletion when a total toner consumption amount calculated based on a sum of the toner consumption amount calculated by the first toner consumption amount calculation section and the toner consumption amount calculated by the second toner consumption amount calculation section exceeds a first threshold value. When a difference between a coefficient reference value and the coefficient calculated by the coefficient calculation section is equal to or greater than an allowable value, the near depletion detector changes the first threshold value at which the near depletion is detected to a second threshold value which is smaller than the first threshold value.

DETAILED DESCRIPTION

Figure 1:
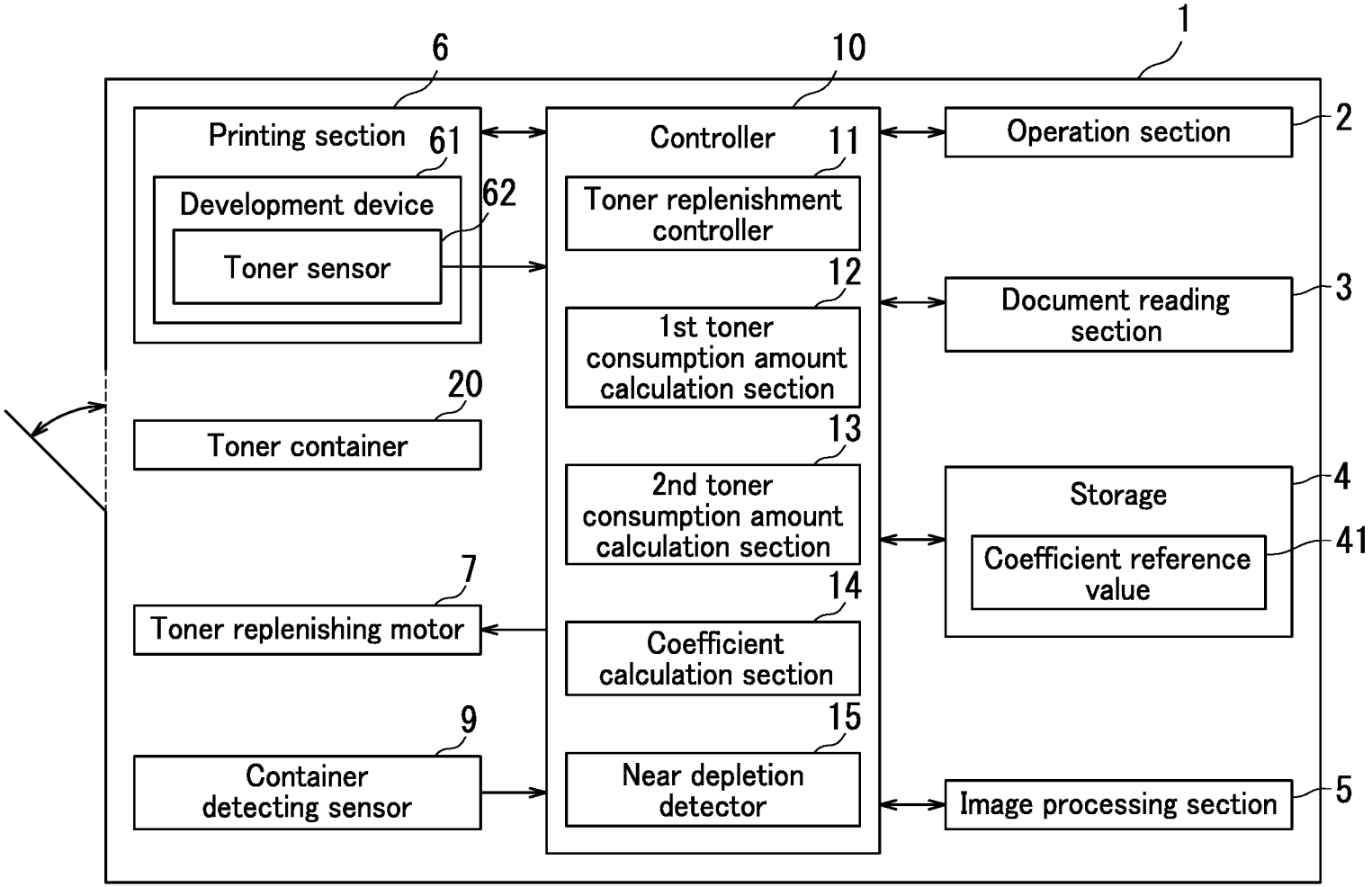
FIG. 1 is a block diagram illustrating a configuration of an image forming apparatus according to an embodiment of the present disclosure.

The following describes an embodiment of the present disclosure in detail with reference to the drawings. Elements of configuration having the same functions are labeled with the same reference numerals in the following embodiment.

An image forming apparatus 1 according to the present embodiment is capable of accepting attachment and detachment of a toner container 20. The toner container 20 houses toner with which a later-described development device 61 is to be replenished. The image forming apparatus 1 is a copier or a multifunction peripheral/printer/product (MFP), for example. Referring to FIG. 1, the image forming apparatus 1 includes an operation section 2, a document reading section 3, storage 4, an image processing section 5, a printing section 6, a toner replenishing motor 7, a container detecting sensor 9, and a controller 10.

The operation section 2 is a user interface which functions as an input section and a display section for instructing performance of a printing process, inputting printing settings, displaying setting values, and displaying error content. Examples of the input section and the display section include a keyboard and a touch panel.

The document reading section 3 is a scanner which reads image data from a document fed by an unillustrated document feeder or placed on contact glass by a user in a manner to irradiate the document with light and receive for example light reflected by the document.

An example of the storage 4 is semiconductor memory or a hard disk drive (HDD) to which a document image (image data) is stored. The storage 4 is also used as memory for image processing or memory to which various settings are stored. The storage 4 may also be a device capable of being externally attached to and detached from the image forming apparatus 1, such as a Secure Digital (SD) card or Universal Serial Bus (USB) memory.

The image processing section 5 is an arithmetic processing circuit such as a microcomputer including elements such as a central processing unit (CPU), read-only memory (ROM), and random-access memory (RAM). For example, the image processing section 5 performs various jobs related to image processing, such as scaling processing, density adjustment processing, and gradation adjustment processing.

An example of the printing section 6 is a printer which prints the document image read by the document reading section 3 or image data received from outside. The printing section 6 includes a development device 61. A latent image is formed on a surface of a photosensitive drum according to image data. The development device 61 develops the latent image with toner to form a toner image. The toner image formed by the development device 61 is transferred from the photosensitive drum to a recording sheet and fixed thereto. The recording sheet is then ejected.

The development device 61 includes a toner sensor 62 which detects an amount of remaining toner in the development device 61. When the amount of remaining toner detected by the toner sensor 62 falls below a preset replenishment threshold value, a toner replenishment operation is performed to replenish the development device 61 with the toner.

The toner container 20 supplies the toner with which the development device 61 is to be replenished. The toner container 20 is replaceable. The toner container 20 includes an ejection screw which ejects the toner from an exit port and a conveyance screw which conveys the toner. The conveyance screw is located in a conveyance path which connects the exit port of the toner container 20 to an entrance port of the development device 61. The ejection screw and the conveyance screw are driven by rotation of the toner replenishing motor 7, and the development device 61 is replenished with the toner from the toner container 20.

The container detecting sensor 9 is a sensor which detects attachment and detachment of the toner container 20 by turning on and off. An example of the container detecting sensor 9 is an optical sensor such as a reflective photosensor, or a mechanical sensor such as a microswitch.

The controller 10 is an arithmetic processing circuit such as a microcomputer including elements such as a CPU, ROM, and RAM. A control program for controlling operation of the image forming apparatus 1 is stored in the ROM. The controller 10 reads out the control program stored in the ROM and deploys the control program in the RAM to control the entire image forming apparatus 1 according to various instruction information input from the operation section 2.

The controller 10 also functions as a toner replenishment controller 11, a first toner consumption amount calculation section 12, a second toner consumption amount calculation section 13, a coefficient calculation section 14, and a near depletion detector 15.

When the amount of remaining toner detected by the toner sensor 62 falls below the preset replenishment threshold value, the toner replenishment controller 11 performs the toner replenishment operation through which the toner replenishing motor 7 is driven for a preset driving period. The toner replenishment controller 11 replenishes the development device 61 with the toner from the toner container 20. After the toner replenishment operation, the toner replenishment controller 11 determines whether or not the amount of remaining toner detected by the toner sensor 62 has returned to a level equal to or greater than a preset threshold value. The threshold value is set to a value larger than the replenishment threshold value.

When the amount of remaining toner has not returned to a level equal to or greater than the preset threshold value, the toner replenishment controller 11 detects that the toner inside the toner container 20 is nearly depleted. To prompt replacement of the toner container 20, the toner replenishment controller 11 notifies the user of toner depletion through the operation section 2.

When the toner level has returned to a level equal to or greater than the preset threshold value, the toner replenishment controller 11 recognizes completion of the toner replenishment operation and ceases operation.

The first toner consumption amount calculation section 12 calculates a toner consumption amount based on the toner replenishment operation through which the development device 61 is replenished with the toner from the toner container 20. That is, the first toner consumption amount calculation section 12 calculates an amount of consumed toner ejected from the toner container 20 according to the toner replenishment operation.

The first toner consumption amount calculation section 12 for example calculates the toner consumption amount using a rotation count of the toner replenishing motor 7. The toner replenishing motor 7 is equipped with a pulse encoder, for example. The first toner consumption amount calculation section 12 measures the rotation count of the toner replenishing motor 7. The first toner consumption amount calculation section 12 calculates an amount of the consumed toner ejected from the toner container 20 based on a replenishment amount per one rotation of the toner replenishing motor 7. Alternatively, the first toner consumption amount calculation section 12 may calculate the toner consumption amount using a rotation period of the toner replenishing motor 7.

The second toner consumption amount calculation section 13 functions as a pixel counting section which counts pixels in data of an image printed by the printing section 6. The second toner consumption amount calculation section 13 calculates the toner consumption amount by multiplying the number of pixels counted by the pixel counting section by a coefficient calculated by the coefficient calculation section 14.

After a later described coefficient reference value 41 is calculated and stored in the storage 4, the coefficient calculation section 14 divides the toner consumption amount calculated by the first toner consumption amount calculation section 12 by the number of pixels counted by the second toner consumption amount calculation section 13 (pixel counting section). The coefficient calculation section 14 thus calculates a coefficient used by the second toner consumption amount calculation section 13 in the process subsequent to the calculation of the coefficient reference value 41.

The coefficient calculation section 14 also calculates a coefficient to be used by the second toner consumption amount calculation section 13 when an initially installed toner container 20 is attached. For a genuine toner container 20 or genuine toner housed in the toner container 20, the coefficient calculation section 14 calculates the coefficient reference value 41 by dividing the toner consumption amount calculated by the first toner consumption amount calculation section 12 by the number of pixels counted by the pixel counting section. The coefficient calculation section 14 stores the calculated coefficient in the storage 4 as a machine-specific coefficient reference value 41. The coefficient reference value 41 is a coefficient calculated by the coefficient calculation section 14 when the initially installed toner container 20 is attached. That is, the initially installed toner container 20 is a genuine product. Accordingly, the coefficient calculated according to genuine toner is stored in the storage 4 as the coefficient reference value 41.

It should be noted that the term "genuine" is synonymous with terms such as "prescribed", "specific", "registered", and "first". The term "non-genuine" is synonymous with terms such as "not registered" and "second or subsequent". However, the second or subsequent toner container 20 may be a genuine product.

In the process subsequent to the calculation of the coefficient reference value 41, the near depletion detector 15 detects near depletion approaching toner depletion when a total toner consumption amount calculated based on a sum of the toner consumption amount calculated by the first toner consumption amount calculation section 12 and the toner consumption amount calculated by the second toner consumption amount calculation section 13 exceeds a first threshold value. The near depletion detector 15 notifies the user of the detected near depletion through the operation section 2.

As an example, in a process in which a second or subsequent toner container 20 is used after use of the first genuine toner container 20 has finished, the near depletion detector 15 may detect near depletion approaching toner depletion when the total toner consumption amount calculated based on the toner consumption amount calculated by the first toner consumption amount calculation section 12 and the toner consumption amount calculated by the second toner consumption amount calculation section 13 exceeds the first threshold value. The near depletion detector 15 notifies the user of the detected near depletion through the operation section 2.

As another example, in a case where use of the first genuine toner container 20 is restarted after a long period of non-use, the near depletion detector 15 may detect near depletion approaching toner depletion when the total toner consumption amount calculated based on the toner consumption amount calculated by the first toner consumption amount calculation section 12 and the toner consumption amount calculated by the second toner consumption amount calculation section 13 exceeds the first threshold value. The near depletion detector 15 notifies the user of the detected near depletion through the operation section 2.

Figure 2:
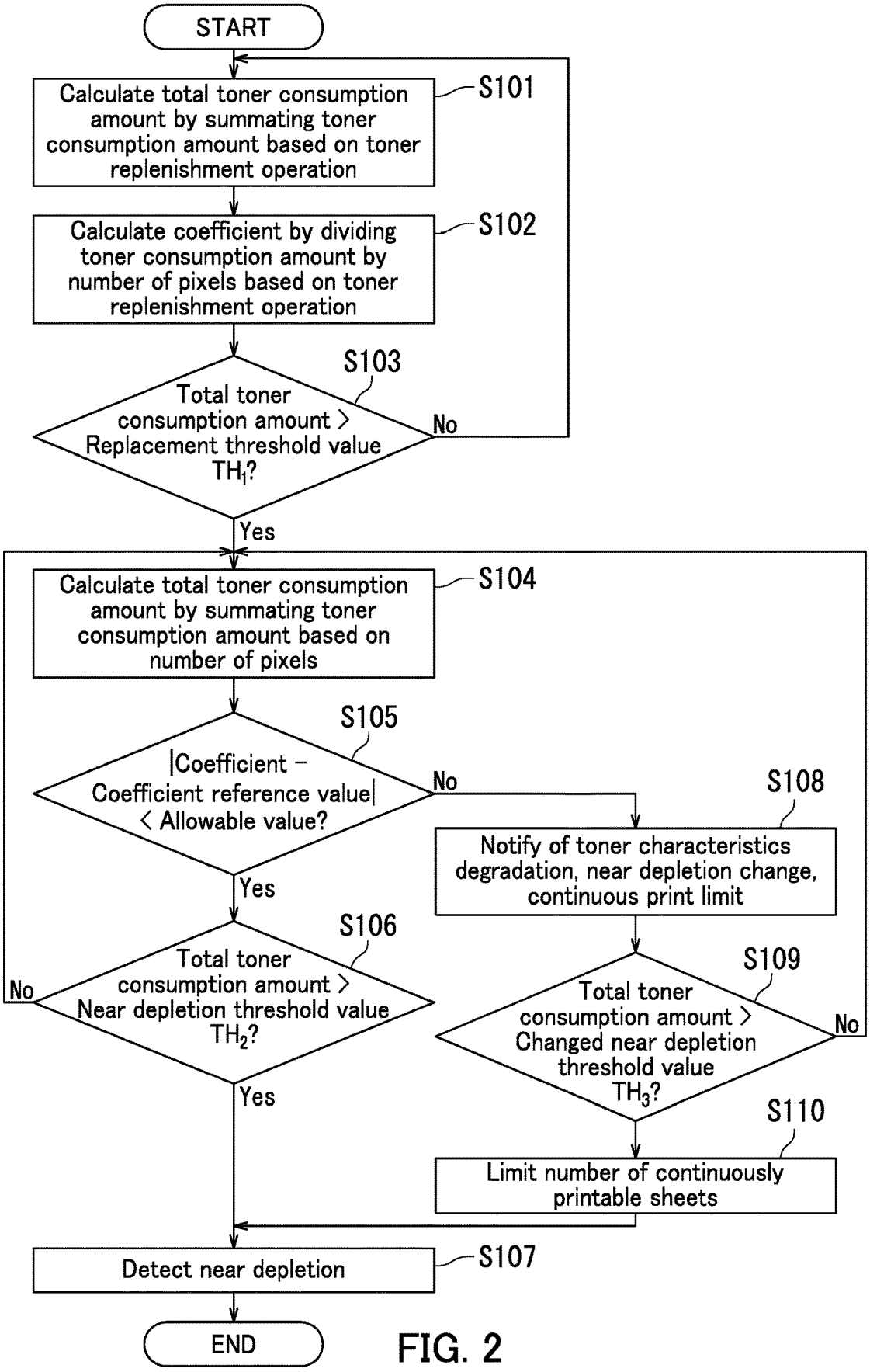
FIG. 2 is a flowchart depicting a near depletion detection operation performed by a near depletion detector illustrated in FIG. 1.

The following describes a near depletion detection operation performed by the near depletion detector 15 in detail with reference to FIG. 2. An outline in FIG. 2 depicts an example of the process performed after the coefficient reference value 41 has been calculated though use of the first genuine toner container 20. For example, when a second or subsequent toner container 20 is used in the process depicted in FIG. 2, the toner consumption amount is continuously summated until the toner consumption amount exceeds a replacement threshold value $TH_1$. When the toner consumption amount exceeds the replacement threshold value $TH_1$, the near depletion detector 15 discerns whether the toner container 20 or the toner housed in the toner container 20 is a genuine product or a non-genuine product based on the coefficient and the coefficient reference value 41. When discerning that the toner container 20 or the toner housed in the toner container 20 is a genuine product, the near depletion detector 15 detects near depletion upon the total toner consumption amount exceeding a near depletion threshold value $TH_2$. When discerning that the toner container 20 or the toner housed in the toner container 20 is a non-genuine product, the near depletion detector 15 changes the near depletion threshold value $TH_2$ to a changed near depletion threshold value $TH_3$ ($TH_3<TH_2$). Alternatively, the near depletion detector 15 may change the near depletion threshold value $TH_2$ to the changed near depletion threshold value $TH_3$ ($TH_3<TH_2$) when discerning that the toner container 20 or the toner housed in the toner container 20 is a genuine product.

The outline in FIG. 2 depicts another example of the process performed after the coefficient reference value 41 has been calculated through use of the first genuine toner container 20. In FIG. 2, for example, a process is considered in which use of the initially installed toner container 20 is suspended, a long period of non-use takes place, and use is subsequently restarted. The first toner consumption amount calculation section 12 continuously summates the toner consumption amount until the toner consumption amount exceeds the replacement threshold value $TH_1$. When the toner consumption amount exceeds the replacement threshold value $TH_1$, the near depletion detector 15 may discern whether or not the toner housed in the toner container 20 has degraded based on the coefficient and the coefficient reference value 41. When discerning that the toner has not degraded, the near depletion detector 15 detects near depletion upon the total toner consumption amount exceeding the near depletion threshold value $TH_2$. When discerning that the toner has degraded, the near depletion detector 15 changes the near depletion threshold value $TH_2$ to the changed near depletion threshold value $TH_3$ ($TH_3<TH_2$).

As depicted in FIG. 2, when the container detecting sensor 9 detects attachment of the toner container 20 (for example, not the initially installed toner container 20 for which the coefficient reference value 41 has been calculated but a second or subsequent toner container 20), the near depletion detector 15 summates the toner consumption amount based on the toner replenishment operation to calculate the total toner consumption amount (Step S101).

The coefficient calculation section 14 divides the toner consumption amount calculated by the first toner consumption amount calculation section 12 by the number of pixels counted by the second toner consumption amount calculation section 13. Through the above calculation, the coefficient calculation section 14 calculates a coefficient used by the second toner consumption amount calculation section 13 (Step S102). The coefficient calculation section 14 calculates the coefficient by dividing the summated value of the toner consumption amount in a coefficient calculation period by the summated value of the number of pixels in the coefficient calculation period. The coefficient calculation period is a period encompassing all or part of a period in which the total toner consumption amount is calculated through toner consumption amount summation based on the toner replenishment operation.

Next, the near depletion detector 15 determines whether or not the total toner consumption amount has exceeded the replacement threshold value $TH_1$ (Step S103). The replacement threshold value $TH_1$ is 60% of the total toner amount of the toner container 20, for example. When the total toner consumption amount is equal to or less than the replacement threshold value $TH_1$ in Step S103, the near depletion detector 15 returns to Step S101 and continues to calculate the total toner consumption amount.

When the total toner consumption amount has exceeded the replacement threshold value $TH_1$ in Step S103, the near depletion detector 15 adds the toner consumption amount calculated by the second toner consumption amount calculation section 13 to the total toner consumption amount calculated in Step S101 to calculate the total toner consumption amount. That is, the near depletion detector 15 adds the toner consumption amount based on the number of pixels to the total toner consumption amount calculated in Step S101 to calculate the total toner consumption amount (Step S104). The second toner consumption amount calculation section 13 calculates the toner consumption amount using the coefficient calculated in Step S102.

Next, the near depletion detector 15 compares the coefficient calculated by the coefficient calculation section 14 to the coefficient reference value 41 stored in the storage 4 and determines whether or not the resulting difference is less than an allowable value to discern whether the toner container 20 or the toner housed in the toner container 20 is for example a genuine product or a non-genuine product (Step S105). Alternatively, the near depletion detector 15 compares the coefficient to the coefficient reference value 41 and determines whether or not the resulting difference is less than the allowable value to discern whether or not the toner is degrading (Step S105).

When the difference is less than the allowable value in Step S105, the near depletion detector 15 discerns that the toner container 20 or the toner housed in the toner container 20 is for example a genuine product. The near depletion detector 15 determines whether or not the total toner consumption amount has exceeded the near depletion threshold value $TH_2$ (first threshold value) (Step S106).

The near depletion threshold value $TH_2$ (first threshold value) is 90% of the total toner amount of the toner container 20, for example. That is, because the amount of remaining toner is known in a case where the toner container 20 or the toner housed in the toner container 20 is a genuine product for example, sudden toner depletion is not thought to occur even when near depletion is detected upon the total toner consumption amount exceeding 90% of the total toner amount in the toner container 20.

When the total toner consumption amount is equal to or less than the near depletion threshold value $TH_2$ in Step S106, the near depletion detector 15 returns to Step S104 and continues to calculate the total toner consumption amount.

When the total toner consumption amount exceeds the near depletion threshold value $TH_2$ (first threshold value) in Step S106, the near depletion detector 15 detects near depletion (Step S107), and the near depletion operation is finished.

When the difference is equal to or greater than the allowable value in Step S105, the near depletion detector 15 discerns that the toner container 20 or the toner housed in the toner container 20 is for example a non-genuine product. The near depletion detector 15 notifies the user through the operation section 2 of degradation of toner characteristics, change of near depletion, and a limit of the number of continuously printable sheets (Step S108). That is, the near depletion detector 15 notifies the user of degradation of toner characteristics and change of near depletion when the difference between the coefficient reference value 41 and the coefficient calculated by the coefficient calculation section 14 is equal to or greater than the allowable value.

The near depletion detector 15 displays a message on the operation section 2 notifying the user that the toner characteristics have degraded. "An increase in toner consumption amount or degradation in printing quality is likely due to degradation of toner. Please contact customer service." is an example of the message notifying the user of degradation of toner characteristics.

The near depletion detector 15 also displays a message on the operation section 2 notifying the user that the timing at which near depletion is detected is accelerating. "The timing at which near depletion is detected is accelerating so that toner will not suddenly become depleted" is an example of the message notifying the user of change of near depletion.

The near depletion detector 15 furthermore displays a message on the operation section 2 notifying the user that a limit has been placed on the number of continuously printable sheets after detection of near depletion. "After detection of near depletion, the number of continuously printable sheets is being limited to prevent machine damage." is an example of the notification of a limit of the number of continuously printable sheets.

Next, the near depletion detector 15 assumes there has been a problematic change in toner characteristics. The near depletion detector 15 changes the near depletion threshold value $TH_2$ (first threshold value) to the changed near depletion threshold value $TH_3$ (second threshold value) which is smaller than the near depletion threshold value $TH_2$ (first threshold value). The near depletion detector 15 determines whether or not the total toner consumption amount has exceeded the changed near depletion threshold value $TH_3$ (second threshold value) (Step S109). The changed near depletion threshold value $TH_3$ (second threshold value) is 80% of the total toner amount of the toner container 20, for example.

That is, because the amount of remaining toner may be unknown in a case where the toner container 20 or the toner housed in the toner container 20 is for example a non-genuine product, the toner may suddenly become depleted when the changed near depletion threshold value $TH_3$ (second threshold value) at which near depletion is detected is not lowered to 80%.

When the total toner consumption amount is equal to or less than the changed near depletion threshold value $TH_3$ (second threshold value) in Step S108, the near depletion detector 15 returns to Step S104 and continues to calculate the total toner consumption amount. The notification described in association with Step S108 may be displayed continuously or temporarily.

When the total toner consumption amount has exceeded the changed near depletion threshold value $TH_3$ (second threshold value) in Step S108, the near depletion detector 15 functions as a continuously printable sheet limiting section which limits the number of continuously printable sheets (Step S110). The near depletion detector 15 detects near depletion upon reaching Step S107, and ceases the near depletion operation.

According to the present embodiment, the near depletion detector 15 is configured to change near depletion after the operation section 2 has notified the user of degradation of toner characteristics, change of near depletion, and a limit of the number of continuously printable sheets. However, the near depletion detector 15 may only propose the change and allow the user to select whether or not to change near depletion using the operation section 2.

According to the present embodiment, the near depletion detector 15 limits the number of continuously printable sheets after the operation section 2 has notified the user of the degradation of toner characteristics, the change of near depletion, and the limit of the number of continuously printable sheets. However, the near depletion detector 15 may only propose the change and allow the user to select whether or not to limit the number of continuously printable sheets using the operation section 2.

Furthermore, when the difference between the coefficient and the coefficient reference value 41 is equal to or greater than the allowable value in Step S105, calibration may be performed. After the calibration is performed, the coefficient calculation section 14 may recalculate the coefficient and the near depletion detector 15 may determine whether or not the difference between the recalculated coefficient and the coefficient reference value 41 is less than the allowable value.

According to the present embodiment as described above, the image forming apparatus 1 accepts attachment and detachment of the toner container 20 housing toner to with which a development device is to be replenished. The image forming apparatus 1 includes the first toner consumption amount calculation section 12, the pixel counting section (second toner consumption amount calculation section 13), the coefficient calculation section 14, and the near depletion detector 15. The first toner consumption amount calculation section 12 calculates a toner consumption amount based on the toner replenishment operation through which the development device is replenished with the toner from the toner container 20. The pixel counting section (second toner consumption amount calculation section 13) counts the pixels in printed image data. The coefficient calculation section 14 calculates the coefficient by dividing the toner consumption amount calculated by the first toner consumption amount calculation section 12 by the number of pixels counted by the pixel counting section. The second toner consumption amount calculation section 13 calculates the toner consumption amount by multiplying the number of pixels counted by the pixel counting section by the coefficient calculated by the coefficient calculation section 14. The near depletion detector 15 detects near depletion approaching toner depletion when the total toner consumption amount calculated based on the sum of the toner consumption amount calculated by the first toner consumption amount calculation section 12 and the toner consumption amount calculated by the second toner consumption amount calculation section 13 exceeds the first threshold value (near depletion threshold value $TH_2$). When the difference between the coefficient reference value 41 and the coefficient calculated by the coefficient calculation section 14 is equal to or greater than an allowable value, the near depletion detector 15 changes the first threshold value at which near depletion is detected to the second threshold value (changed near depletion threshold value $TH_3$) which is smaller than the first threshold value.

Through the above, sudden toner depletion can be prevented because the timing at which near depletion is detected can be accelerated even in a case where the characteristics of the toner are widely different.

Also according to the present embodiment, the coefficient reference value 41 is a coefficient calculated by the coefficient calculation section 14 when the initially installed toner container 20 is attached.

Through the above, the coefficient reference value 41 can be obtained as a machine-specific value for use of genuine toner.

Also according to the present embodiment, the near depletion detector 15 notifies the user through the operation section 2 of degradation of toner characteristics and change of near depletion when the difference between the coefficient reference value 41 and the coefficient calculated by the coefficient calculation section 14 is equal to or greater than the allowable value.

Through the above, the user is made aware of degradation of toner characteristics and change of near depletion, and can prepare the next toner container 20 early.

Also according to the present embodiment, when the difference between the coefficient reference value 41 and the coefficient calculated by the coefficient calculation section 14 is equal to or greater than the allowable value, the near depletion detector 15 functions, after detection of near depletion, as a continuously printable sheet limiting section which limits the number of continuously printable sheets.

Through the above, machine damage caused by toner scattering or the like due to a large change in toner characteristics during continuous printing can be prevented.

Also according to the present embodiment, the near depletion detector 15 notifies the user of a limit of the number of continuously printable sheets when the difference between the coefficient reference value 41 and the coefficient calculated by the coefficient calculation section 14 is equal to or greater than the allowable value.

Through the above, the user can perform a printing instruction while being aware of the limit of the number of continuously printable sheets.

It should be noted that the present disclosure is not limited to the above embodiment. It is obvious that the embodiment may be appropriately altered within a scope of the technical idea of the present disclosure. Aspects of the above elements of configuration such as number, position, and shape thereof are not limited to the above embodiment. Any number, position, shape, or the like appropriate for implementing the present disclosure may be used.

What is claimed is:

1. An image forming apparatus which accepts attachment and detachment of a toner container, the toner container housing toner with which a development device of the image forming apparatus is replenished, the image forming apparatus comprising:

a first toner consumption amount calculation section configured to calculate a first toner consumption amount based on a toner replenishment operation through which the development device is replenished with the toner from the toner container under control of a processor;

a pixel counting section configured to count pixels in printed image data under control of the processor;

a coefficient calculation section configured to calculate a coefficient by dividing the first toner consumption amount calculated by the first toner consumption amount calculation section by a number of the pixels counted by the pixel counting section in image data printed with toner in the first toner consumption amount under control of the processor;

a near depletion detector configured to determine, under control of the processor, whether or not the first toner consumption amount has exceeded a replacement threshold value; and a second toner consumption amount calculation section configured to calculate, under control of the processor, a second toner consumption amount by multiplying a number of pixels in image data printed after the near depletion detector determines that the first toner consumption amount has exceeded the replacement threshold value by the coefficient calculated by the coefficient calculation section, wherein the near depletion detector determines whether or not a difference between the coefficient and a coefficient reference value has exceeded an allowable value, upon the difference between the coefficient and the coefficient reference value being less than the allowable value, the near depletion detector detects near depletion approaching toner depletion when a total toner consumption amount calculated based on a sum of the first toner consumption amount and the second toner consumption amount exceeds a first threshold value, and upon the difference between the coefficient and the coefficient reference value being equal to or greater than the allowable value, the near depletion detector detects the near depletion when the total toner consumption amount exceeds a second threshold value which is lower than the first threshold value.

2. The image forming apparatus according to claim 1, wherein the coefficient reference value is the coefficient calculated by the coefficient calculation section when an initially installed toner container is attached.

3. The image forming apparatus according to claim 1, wherein the near depletion detector notifies of degradation of toner characteristics and change of the near depletion when the difference between the coefficient reference value and the coefficient calculated by the coefficient calculation section is equal to or greater than the allowable value.

4. The image forming apparatus according to claim 1, further comprising a continuously printable sheet limiting section configured to limit, under control of the processor, after detection of the near depletion, a number of continuously printable sheets when the difference between the coefficient reference value and the coefficient calculated by the coefficient calculation section is equal to or greater than the allowable value.

5. The image forming apparatus according to claim 4, wherein the near depletion detector notifies of a limit of the number of continuously printable sheets when the difference between the coefficient reference value and the coefficient calculated by the coefficient calculation section is equal to or greater than the allowable value.

6. The image forming apparatus according to claim 1, wherein for a genuine toner container or a toner housed in the genuine toner container, the coefficient calculation section calculates the coefficient reference value by dividing the first toner consumption amount calculated by the first toner consumption amount calculation section by the number of pixels counted by the pixel counting section.

7. A method for detecting near depletion approaching toner depletion in a toner container of an image forming apparatus which accepts attachment and detachment of the toner container, the toner container housing toner with which a development device of the image forming apparatus is replenished, the method comprising:

calculating a first toner consumption amount based on a toner replenishment operation through which the development device is replenished with the toner from the toner container under control of a processor;

counting pixels in printed image data under control of the processor;

calculating, under control of the processor, a coefficient by dividing the first toner consumption amount by a number of the pixels in image data printed with toner in the first toner consumption amount;

determining, under control of the processor, whether or not the first toner consumption amount has exceeded a replacement threshold value;

calculating, under control of the processor, a second toner consumption amount by multiplying a number of pixels in image data printed after it is determined that the first toner consumption amount has exceeded the replacement threshold value by the coefficient;

determining, under control of the processor, whether or not a difference between the coefficient and a coefficient reference value has exceeded an allowable value;

detecting, upon the difference between the coefficient and the coefficient reference value being less than the allowable value, near depletion approaching toner depletion under control of the processor when total toner consumption amount calculated based on a sum of the first toner consumption amount and the second toner consumption amount exceeds a first threshold value; and detecting, upon the difference between the coefficient and the coefficient reference value being equal to or greater than the allowable value, near depletion approaching toner depletion under control of the processor when the total toner consumption amount exceeds a second threshold value which is lower than the first threshold value.

8. The method according to claim 7, wherein the coefficient reference value is a coefficient when an initially installed toner container is attached.

9. The method according to claim 7, further comprising notifying under control of the processor, degradation of toner characteristics and change of the near depletion when the difference between the coefficient reference value and the coefficient is equal to or greater than the allowable value.

10. The method according to claim 7, further comprising limiting, after detection of the near depletion, a number of continuously printable sheets under control of the processor when the difference between the coefficient reference value and the coefficient is equal to or greater than the allowable value under.

11. The method according to claim 10, further comprising notifying a limit of the number of continuously printable sheets under control of the processor when the difference between the coefficient reference value and the coefficient is equal to or greater than the allowable value.

12. The method according to claim 7, further comprising calculating the coefficient reference value by dividing the first toner consumption amount by the number of pixels in image data under control of the processor for a genuine toner container or a toner housed in the genuine toner container.

* * * * *